United States Patent [19]

King

[11] 4,066,374

[45] Jan. 3, 1978

[54] TRENCH COMPACTOR

[76] Inventor: Arthur Elgin King, P.O. Box 495, Grass Valley, Calif. 95945

[21] Appl. No.: 716,255

[22] Filed: Aug. 20, 1976

[51] Int. Cl.[2] ..... E01C 19/38

[52] U.S. Cl. ..... 404/117; 404/121; 404/127; 172/477; 172/742

[58] Field of Search ..... 404/127, 128, 133, 117; 172/477

[56] References Cited

U.S. PATENT DOCUMENTS

| | | | |
|---|---|---|---|
| 2,120,745 | 6/1938 | Greiner | 404/128 X |
| 2,338,056 | 12/1943 | Penote | 404/133 |
| 2,852,992 | 9/1958 | Simmonds | 404/133 |
| 2,891,335 | 6/1959 | Linneman | 404/127 X |
| 3,072,025 | 1/1963 | Cronin | 404/127 |
| 3,217,620 | 11/1965 | Mindrum | 404/133 X |
| 3,665,823 | 5/1972 | Chaney | 404/128 |
| 3,891,342 | 6/1975 | Roe | 404/128 |
| 3,895,880 | 7/1975 | Fink | 404/128 X |
| 3,932,052 | 1/1976 | Fink | 404/128 |

*Primary Examiner*—Nile C. Byers
*Attorney, Agent, or Firm*—Mark C. Jacobs

[57] ABSTRACT

A vibratory sheepsfoot is attached to a coupling assembly that is mounted on a hydraulically operated tool bar on the back of a tractor. The coupling assembly is designed to permit adjustability of the vibratory sheepsfoot in a vertical direction. The coupling assembly is mounted on the tool bar such that it can be moved along the length of the tool bar to a desired position. The apparatus is especially useful in compacting earth in a trench offset to the side of the tractor.

13 Claims, 5 Drawing Figures

TRENCH COMPACTOR

BACKGROUND OF THE INVENTION

This invention relates to an apparatus for compacting earth. More particularly, this invention relates to an apparatus for compacting earth in trenches and the like.

At the present time there are several different types of machines that are used to compact earth. One type of machine that is frequently used is what is known in the trade as a sheepsfoot. An example of a sheepsfoot may be found in U.S. Pat. No. 3,183,804. Although the sheepsfoot has proven to be an effective low cost per yard approach to surface compaction its usefulness in trench line compaction has never been fully realized.

In U.S. Pat. No. 2,146,101 is disclosed an apparatus for compacting earth in trenches. The apparatus includes a sheepsfoot connected to a pulling vehicle by a coupling assembly such that it can be towed by the pulling vehicle but not raised or lowered or moved from side to side of the pulling vehicle.

In U.S. Pat. No. 3,471,953 is disclosed an apparatus for compacting earth in trenches which includes a sheepsfoot positioned centrally of a pulling vehicle such that the pulling vehicle must straddle the trench at all times.

Other types of sheepsfoot apparatus are disclosed in U.S. Pat. Nos. 3,136,078; 3,183,804; and 2,437,524. Other types of machines for compacting earth are disclosed in U.S. Pat. Nos. 2,732,197 and 2,852,992.

In U.S. Pat. No. 3,024,546 is disclosed an apparatus for digging ditches which includes a ditcher head that is mounted for lateral and vertical movement. In the apparatus, the adjustable ditcher is spaced laterally to the right of the tread of the tractor with the tractor moving forward. There are several shortcomings to such an apparatus. Firstly, it is not an earth compacter, but more importantly, the operator can not readily shift to the opposite side or place his ditcher anywhere between the tread lines.

Such shortcomings are not found in the apparatus of this invention. In addition, this invention can be employed without the need to add additional fill dirt as would seem to be taking place at all times in the apparatus in U.S. Pat. No. 3,471,953.

The present invention relates primarily to the field of underground utility work; that is, the laying of pipe or wires in trenches. The steps involved in such a project include site preparation, trenching, laying of pipe or wire, backfill, compaction and site restoration. All aspects of the total task, with the exception of compaction have advanced rapidly to a high degree of sophistication in recent years.

The compaction step is in fact a plurality of steps which include preparatory compaction of the trench bottom, the compaction of material in and around the pipe or wires and the compaction of the trench above the newly laid pipe or conduit. The ability to produce work that meets specification and yet be monetarily productive has lagged with the advent of more strigent requirements of O.S.H.A., as well as the advances made in other aspects of the total job. This has resulted in a disproportionate cost in compaction in relation to the work as a whole.

Furthermore, all field backfill work is governed by soils laboratory measured achievable compaction using precise measurements of weight, moisture and expended effort for controlled test cores, with the result that actual field requirements are related as a percentage of laboratory results, and are called out as relative density, i.e. the field density test is relative to the laboratory test core.

In the present state of the art there are basically five different mechanical modes of attempting to achieve the desired field densities.

The most common is the gasoline powered, stomping type of unit or whacker, which is operated by one man, which is designed for use on relatively flat small area surfaces and which requires the operator to follow the machine into the trench.

Another common unit is the hydraulic backhoe mounted Hoe-Pac. This type of device is basically a vibrated plate. The chief handicap of such a device is its inability to produce a continuous effort, and the necessity of the prime mover, i.e. the tractor, to straddle the trench, which is not always safe or even possible.

Other known devices used are the dual drum self-propelled roller, as made and sold by Duomat, Mikasa and otheres; and the drop hammer type of unit as made by Arrow Champion and others. The dual drum roller suffers the shortcomings of the wacker. The drop hammer which must also straddle the trench, requires the trench to be jetted, a term known to the art, for it to be effective. Ofttimes only the upper area meets the relative density compaction, specification, while the deeper areas do not. Also there is the danger of pipe floating during the jetting operation.

The vibratory sheepsfoot has in recent years been recognized as an effective low cost per yard approach to compaction. However, prior use has been limited to surface compaction on surfaces up to about 6' in width and large diameter pipelines, because there was no way of utilizing it within a trench of the size used in normal pipeline operations. The invention of this application allows a narrow vibratory sheepsfoot to be employed in a backfill trenching operation with dramatic results both in productivity and safety to the workmen.

SUMMARY OF THE INVENTION

It is an object of this invention to provide a new and improved apparatus for compacting earth in trenches.

It is another object of this invention to provide an apparatus for compacting earth in trenches which includes a prime mover that does not straddle the trench.

It is still another object of this invention to provide a sheepsfoot type earth compactor for use in trenches which can be operated completely from outside the trench.

It is yet still another object of this invention to provide an apparatus for compacting earth in trenches which includes a sheepsfoot that is connected to a supporting vehicle such that it has complete maneuverability and mobility.

It is yet still another object of this invention to provide a new and novel coupling assembly for attaching a sheepsfoot to a prime mover.

It is an object also to provide a compaction machine which has the ability within itself to avoid any trench line obstructions, e.g. valves, manholes and existing crosslines of piping.

Yet another object is to provide a technique whereby no person is required to enter a trench during backfilling, thereby, eliminating the need for trench shoring in accordance with governmental regulations, thus reducing costs of operation to the contracting party.

A further object is to provide a sheepsfoot compacting device which can operate at any depth requirement and be controlled from a prime mover that operates either to one side of the trench bottom or above and straddling the trench, as the particular job may deem best.

The above and other objects are achieved, according to this invention, by providing an apparatus for compacting earth which includes a prime mover having a hydraulically operated toolbar, a coupling assembly mounted for movement along the length of the toolbar and a sheepsfoot attached to the toolbar, the coupling assembly being designed to provide for vertical movement of the sheepsfoot, with all controls for the movement and operation of the tool bar, the coupling assembly, and the sheepsfoot being within the reach of an operator seated on the prime mover.

In addition to the characteristics described above, the invention has many other advantages and has other objects and features which will become more clearly evident from a consideration of the illustrative embodiment of the invention described and depicted in the accompanying drawings and forming a part of the specification. The preferred embodiment will be described in detail to illustrate the general principles of the invention, it being understood that the invention is best defined by the appended claims. It is further to be understood, that in the Figures, like numerals will be utilized to refer to like parts.

DESCRIPTION OF PREFERRED EMBODIMENT

Figure 1:
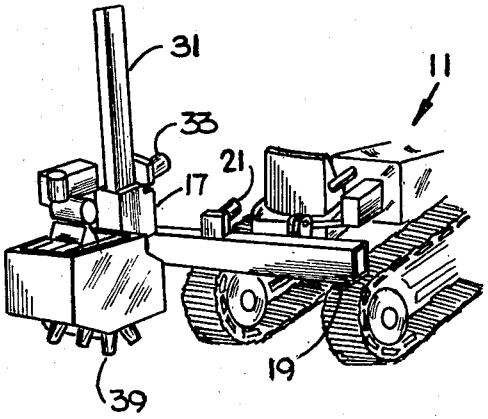
FIG. 1 is a perspective view of the invention as seen positioned behind the prime mover.
Figure 3:
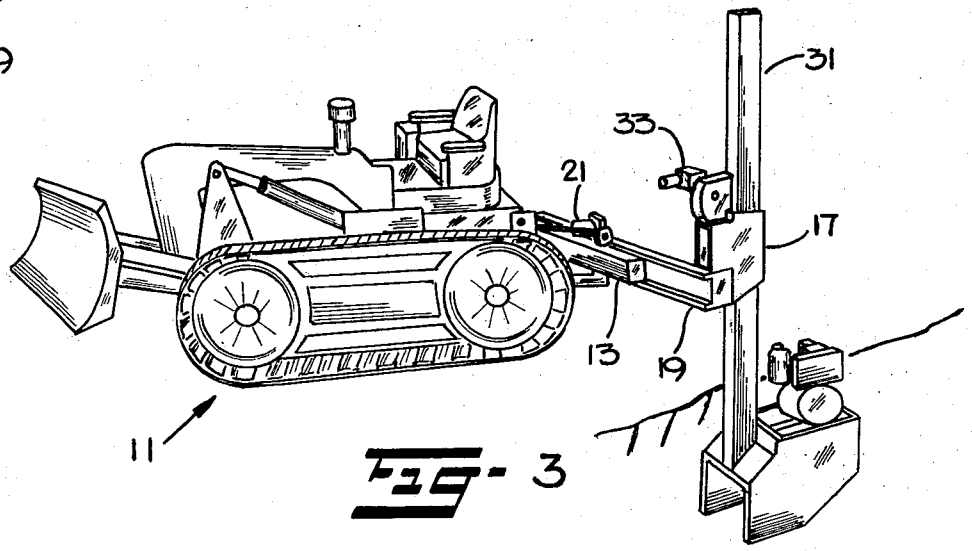
FIG. 3 is a right front view of the apparatus in a raised position over a trench.
Figure 2:
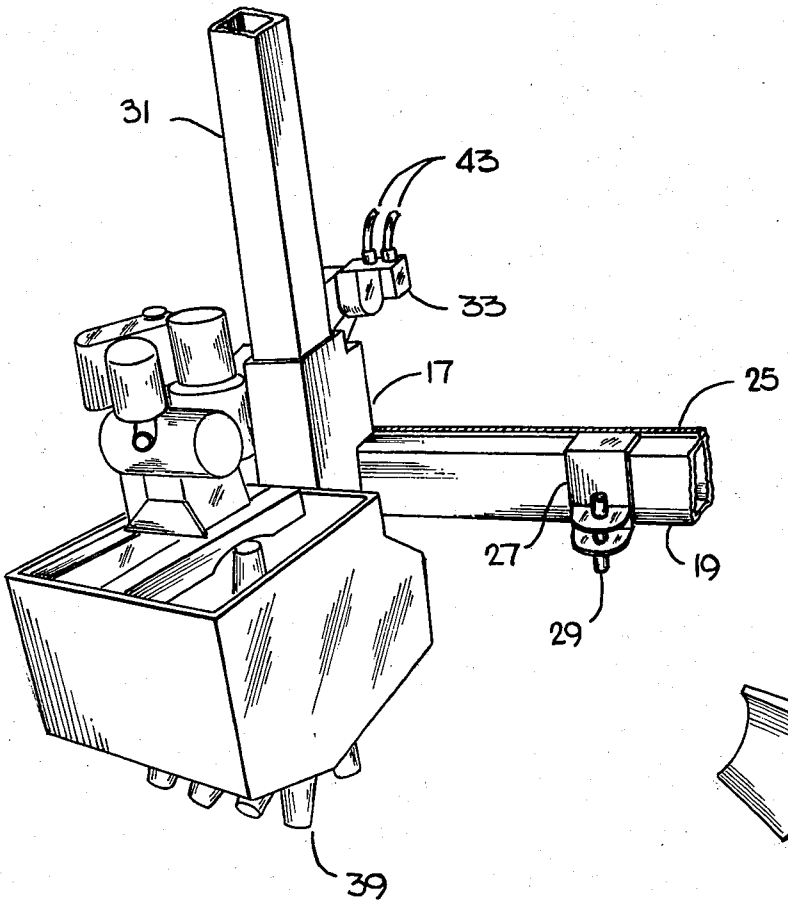
FIG. 2 is a closeup perspective view of an apparatus according to this invention.
Figure 5:
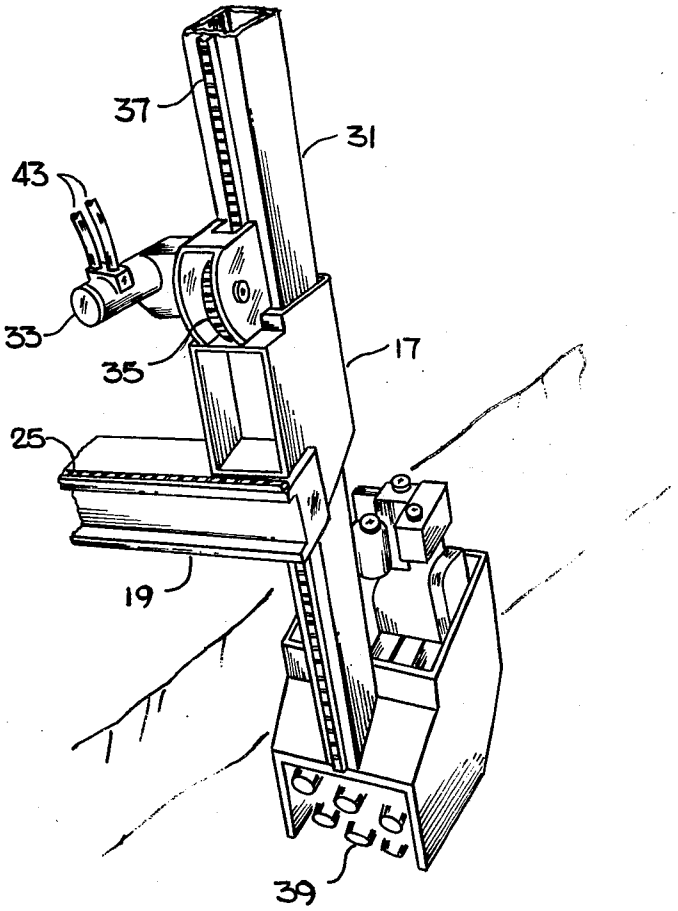
FIG. 5 shows the apparatus extended out along the draw bar with the sheepsfoot showing, the device being below surface in this right perspective view.
Figure 4:
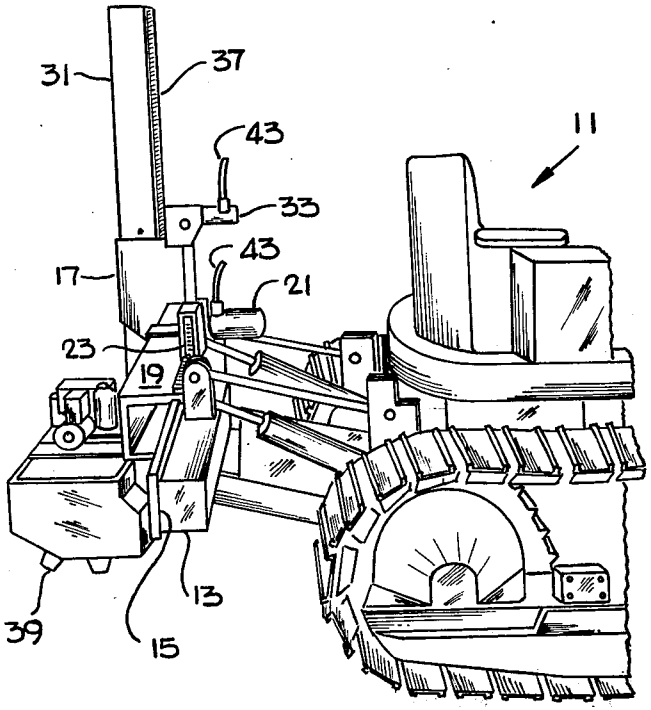
FIG. 4 is a left end perspective view with the apparatus extended to the right but not lowered below ground level.

Referring to the drawings there is shown an apparatus constructed according to this invention. The apparatus includes a tractor 11 having a hydraulically operated tool bar 13 on the back end. A guide rail 15 is rigidly secured to the toolbar 13. The guide rail 15 extends from one end of the toolbar 13 to the other end. Mounted on the guide rail 15 is a coupling assembly indicated generally by reference numeral 17. The coupling assembly 17 includes a box bar 19 which is movably mounted on the guide rail 15. The box bar 19 is moved along the guide rail 15 by means of a motor 21 which is mounted on the toolbar 13, the motor 21 having a gear wheel 23 which engages a chain 25 rigidly fixed to and extending along the length of the box bar 19. Instead of a gear wheel and chain arrangement, movement of the box bar 19 relative to the guide rail 15 may be achieved if desired by other means such as, for example, a rack and pinion or a hydraulic cylinder. A collar attachment 27 is pivotally mounted onto the box bar 19 near one end by means of a pivot pin 29. A mast member 31 is telescopically mounted inside the coupling assembly 17. Movement of the mast member 31 relative to the coupling assembly 17 is achieved by means of motor 33 mounted on the coupling assembly 17 and having a gear wheel 35 which engages a chain 37 fixed to and extending along the length of the mast member 31. Movement of the mast member 31 relative to the collar attachment 27 may also be achieved by other means such as a rack and pinion or a motor. Mounted on the bottom of the mast member 31 is a vibratory sheepsfoot machine 39. The motor 33 for the mast member 31 and the motor 21 for the box bar 19 are both connected by hydraulic lines 43 to a set of controls on the tractor 11. The motor 33 for the vibratory sheepsfoot machine 39 is a self contained unit controlled by the operator electrically. Such controls enable the operator to move the tool bar 13 from a neutral or inoperative position to an operating position; to move the box bar 19 horizontally to either side of the tractor 11; to raise and lower the sheepsfoot 39 and to operate the sheepsfoot 39 in a conventional manner.

It is seen that the vibratory sheepsfoot, which in recent years has been recognized as an effective low cost per yard approach to surface compaction has been successfully adapted for use in a trench, by means of the invention of this application. By adopting this compaction instrument for use in trenches, the operator of the unit is able to utilize narrower diameter trenches than with prior art techniques and devices. By using this device in conjunction with the attachment of this invention it is seen that compaction energies can be applied to trench fill that equal those capable of being applied by surface acting equipment.

By avoiding the need to enter the trench, significant cost savings can be achieved with respect to shoring in accordance with local and federal governmental regulations.

In view of the fact that the prime mover operates outside of the trench, it is seen that manholes, crosslines and other obstructions are avoided merely by raising and lowering the sheepsfoot. Thus production is rendered continuous and comparable to achievable rates of other surface acting pipeline construction equipment.

Further cost savings are possible in that this invention is easily adaptable to any prime mover; and since the instant device can be raised and lowered the prime mover can place its own backfill in the trench and grade its own soil from the surface both without any obstruction or interference from the inventive device, thereby eliminating the need for support equipment and operators.

Since the portion slides coupling assembly 17 can be moved along the tool bar 13 at will, it is seen that the sheepsfoot 39 can be utilized on either side of the tractor 11. Since the tractor 11 can operate both forward and back the actual advantage in being able to shift to the opposite side is in being able to allow the tractor 11 to operate in a forward direction going up slopes; a condition in which the tractor 11 mover is much more effective (i.e. pulling the compactor than attempting to push it).

The apparatus is used in the following manner. First, the tractor 11 is moved next to the trench to be worked on. Then, the box bar 19 is moved to one side so as to position the sheepsfoot 39 over the trench. Then, the tool bar 13 is lowered to a neutral position. Finally, the sheepsfoot 39 is lowered into the trench. It is to be understood, of cource, that the apparatus may be also used with the tractor straddling the trench, if so desired.

It is to be noted that the tool bar 13 is free to "float" while the sheepsfoot 39 is in operation. The height of the tool bar 13 is controlled by the relative location of the mast member 31 in the coupling assembly 17. When it is desired to remove the sheepsfoot 39 from the trench it is working in, the tool bar 13 is first returned to a positive "left" condition. This is achieved hydraulically.

It can be seen that the weight utilized in compacting soil using the apparatus of this invention includes the sum of the weight of the tool bar 13, the guide rail 15, the box bar 19, the collar 27, the mast 31 and the sheepsfoot 39.

It will be obvious to those skilled in that art that many variations may be made in the embodiment here chosen for the purpose of illustrating the present invention, without departing from the scope thereof as defined in the appended claims.

What is claimed is:

1. A primemover mountable device for compacting dirt in an area located at the side of and parallel to the direction of movement of said prime mover or in line therewith comprising:

a. a tool bar mountable on one end of a primemover perpendicular to the direction of travel of said mover, b. a guide rail coextensive in length to said tool bar, the length of said rail being rigidly secured thereto along the length thereof, c. extending means, movably mounted on said guide rail and laterally extendable along said guide rail, d. a coupling means movably mounted on said extending means and having a vertical bore therethrough for movement of a mast therein, e. a mast disposed in said bore of said assembly, and vertically movable therein, and f. a vibratory earth compacting device mounted on the lower end of said mast wherein vertical movement of the mast brings said device into operative position for compacting dirt in the area along side of said primemover.

2. The apparatus of claim 1 and wherein the prime mover is a tractor.

3. The apparatus of claim 2 and wherein the tool bar is located at the rear of the tractor.

4. The apparatus of claim 3 and wherein the tool bar is hydraulically operated.

5. The apparatus of claim 1 wherein the guide rail is of an elevation greater than that of the tool bar, and is affixed to the front face of the tool bar.

6. The apparatus of claim 1 wherein the extending means is a box bar having a pair of forwardly extending parallel extended portions, on one face, along the length of said bar, and adapted to engage said guide rail between said extensions.

7. The apparatus of claim 6 and wherein the earth compacting machine is a sheepsfoot.

8. The apparatus of claim 1 including means for laterally moving the coupling means with said mast therein relative to the length of said tool bar.

9. The apparatus of claim 8 further including means for raising and lowering the mast.

10. The apparatus of claim 1 including means for raising and lowering said mast, and wherein said compacting device is a sheepsfoot.

11. The apparatus of claim 10, wherein the dirt area is a trench along side of said primemover, and the raising and lowering means includes means to raise and lower the mast into said trench.

12. The apparatus of claim 1 wherein the tool bar is mountable at the rear of the primemover and said compacting device is a sheepsfoot.

13. Apparatus for compacting earth comprising:

a. a tractor, said tractor having a hydraulically operated tool bar mounted on its rear end, b. a guide rail rigidly secured to the tool bar, along the length thereof, c. a box bar laterally movable thereon, mounted on the guide rail, and d. a coupling assembly movably secured to the box bar, e. a mast mounted for vertical movement in the coupling assembly, and f. a vibratory sheepsfoot attached to the bottom of the mast, and g. a motor mounted on said coupling assembly for vertically moving said mast.

* * * * *